US007182835B2

(12) United States Patent
Lindström et al.

(10) Patent No.: US 7,182,835 B2
(45) Date of Patent: Feb. 27, 2007

(54) TWO-STAGE CHLORINE BLEACHING PROCESS WITH FILTRATE RECIRCULATION

(75) Inventors: Lars-Åke Lindström, Sundsvall (SE); Solveig Nordén, Njurunda (SE); Gunnar Carré, Sundsvall (SE)

(73) Assignee: Metso Paper, Inc. (FI)

( * ) Notice: Subject to any disclaimer, the term of this patent is extended or adjusted under 35 U.S.C. 154(b) by 283 days.

(21) Appl. No.: 10/344,425

(22) PCT Filed: Aug. 14, 2001

(86) PCT No.: PCT/SE01/01752

§ 371 (c)(1),
(2), (4) Date: Feb. 12, 2003

(87) PCT Pub. No.: WO02/14600

PCT Pub. Date: Feb. 21, 2002

(65) Prior Publication Data

US 2003/0178163 A1 Sep. 25, 2003

(30) Foreign Application Priority Data

Aug. 14, 2000 (SE) ..... 0002930

(51) Int. Cl.
*D21C 9/10* (2006.01)
*D21C 9/14* (2006.01)
*D21C 9/18* (2006.01)

(52) U.S. Cl. ..... 162/29; 162/37; 162/56; 162/65; 162/78; 162/88

(58) Field of Classification Search ..... 162/18, 162/56, 29, 37, 65, 76, 89, 87–88, 78
See application file for complete search history.

(56) References Cited

U.S. PATENT DOCUMENTS

| | | | | |
|---|---|---|---|---|
| 3,652,387 | A * | 3/1972 | Wilder | 162/25 |
| 4,039,372 | A | 8/1977 | Reeve et al. | |
| 4,104,114 | A * | 8/1978 | Rowlandson et al. | 162/29 |
| 5,118,389 | A | 6/1992 | Dubelsten et al. | |
| 5,356,517 | A * | 10/1994 | Pedersen et al. | 162/72 |
| 5,853,535 | A * | 12/1998 | Maples et al. | 162/30.1 |
| 6,136,041 | A * | 10/2000 | Jaschinski et al. | 8/111 |
| 6,315,863 | B1 * | 11/2001 | Jack | 162/40 |
| 6,569,284 | B1 * | 5/2003 | Yin et al. | 162/29 |
| 7,077,931 | B2 * | 7/2006 | Snekkenes et al. | 162/70 |
| 2003/0178163 | A1 * | 9/2003 | Lindstrom et al. | 162/37 |
| 2004/0149404 | A1 * | 8/2004 | Snekkenes et al. | 162/60 |
| 2006/0090866 | A1 * | 5/2006 | Gustavsson et al. | 162/60 |

FOREIGN PATENT DOCUMENTS

| | | | |
|---|---|---|---|
| DE | 25 39 402 | A1 | 3/1976 |
| WO | WO 200214600 | A1 * | 2/2002 |

* cited by examiner

*Primary Examiner*—José A. Fortuna
(74) *Attorney, Agent, or Firm*—Lerner, David, Littenberg, Krumholz & Mentlik, LLP

(57) ABSTRACT

Methods for bleaching chemical pulp are disclosed including dewatering the pulp to a concentration of from 25 to 40%, bleaching in a first chlorine dioxide stage, followed by a second alkaline bleaching stage, followed by a third chlorine dioxide bleaching stage, dewatering the bleached pulp to a concentration of from 10 to 40% and producing a filtrate, and recycling the filtrate to control the pulp concentration of the dewatered chemical pulp to from 8 to 15% in the first bleaching stage.

5 Claims, 1 Drawing Sheet

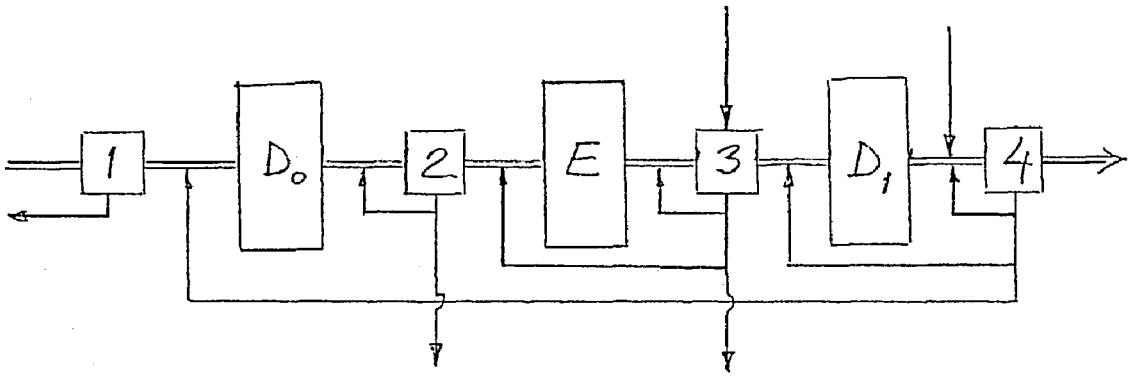
1
$D_0$
2
E
3
$D_1$
4

TWO-STAGE CHLORINE BLEACHING PROCESS WITH FILTRATE RECIRCULATION

FIELD OF THE INVENTION

The present invention relates to a method of bleaching lignocellulosic fibrous material in the form of chemical pulp. More particularly, the present invention relates to such a method with two bleaching stages with chlorine dioxide as the dominant bleaching chemical and at least one intermediate alkaline bleaching stage.

BACKGROUND OF THE INVENTION

The bleaching of chemical pulp is generally carried out in a sequence, which comprises several bleaching stages with different bleaching chemicals. A usual bleaching sequence comprises a first chlorine dioxide stage ($D_0$) followed by an alkaline bleaching stage (E) and a second chlorine dioxide stage ($D_1$). The chlorine dioxide stages are normally carried out only with chlorine dioxide, but alternatively the chlorine dioxide can be completed with other chemicals such as ozone. The chemicals are added in different phases of the bleaching stage. The alkaline bleaching stage is normally an extraction stage, with the addition of oxygen gas and peroxide (EOP). Alternatively, the alkaline stage can be completed with an ozone phase, which is then carried out under acid conditions.

One object of the bleaching of pulp is to increase the ISO-brightness of the pulp, which implies that impurities and discoloring matter are dissolved out of the pulp and removed by washing/dewatering before and after the bleaching stages by means of filters or presses. The filtrate from the dewatering stage can, to a large, extent be re-cycled and used for washing and dilution in previous stages of the process in order to minimize the emissions of dissolved substances. For environmental reasons a low effluent volume is desired, but reflux of the filtrate causes a build-up of the substance content in the bleaching stages, with the resulting risk of increased chemical consumption.

In bleaching sequences of the aforedescribed type the chlorine dioxide stages are carried out with a pulp of mean concentration (about 8 to 15%). As it is desired prior to the first chlorine dioxide stage ($D_0$) to remove dissolved substances from previous treatment stages to the greatest possible extent, the pulp is dewatered by pressing to high concentrations (about 25 to 40%). It is, therefore, necessary to lower the pulp concentration by dilution before the pulp is introduced into the bleaching stage. This dilution step is often carried out with clean water, but by using instead the filtrate from the washing/dewatering directly after the bleaching stage ($D_0$) the filtrate flow, and thereby also the total effluent volume, from the process could be reduced.

This recycling of filtrate, however, has the disadvantage of deteriorating the ISO-brightness of the pulp. In order to compensate for this, increased chemical addition is required, which involves higher costs.

SUMMARY OF THE INVENTION

In accordance with the present invention, these and other disadvantages of the prior art have been overcome by the discovery of a method for bleaching chemical pulp comprising dewatering the chemical pulp to a concentration of 25–40%, bleaching the dewatered chemical pulp in a first bleaching stage with chlorine dioxide to produce a partially bleached chemical pulp, bleaching the partially bleached chemical pulp in a second bleaching stage with alkaline bleaching chemicals to produce an alkaline bleached chemical pulp, bleaching the alkaline bleached chemical pulp in a third bleaching stage with chlorine dioxide to produce a bleached chemical pulp, dewatering the bleached chemical pulp to a concentration of from 10–40%, producing a filtrate thereby, and recycling the filtrate to control the pulp concentration of the dewatered chemical pulp to from 8–15% in the first bleaching stage. Preferably, the dewatering of the chemical pulp and the dewatering of the bleached chemical pulp are carried out by means of roller presses.

In accordance with one embodiment of the method of the present invention, the second bleaching stage comprises an extraction stage with the addition of oxygen gas and/or hydroperoxide.

In accordance with another embodiment of the method of the present invention, the method includes dewatering the partially bleached chemical pulp and dewatering the alkaline bleached chemical pulp. Preferably, the dewatering of the partially bleached chemical pulp and the dewatering of the alkaline bleached chemical pulp are carried out by means of roller presses.

In accordance with the present invention the aforesaid problems are solved by a more advantageous re-cycling of the filtrate in the process. Thus, unfavorable build-up of the substance content in the bleaching process is avoided, and the ISO-brightness of the pulp is improved.

The present invention relates to a method of bleaching chemical pulp, comprising two bleaching stages with chlorine dioxide as the dominant bleaching chemical and at least one intermediate alkaline bleaching stage. The chlorine dioxide stages, ($D_0$) and ($D_1$), can be pure chlorine dioxide stages or bleaching stages where chlorine dioxide is completed with some other bleaching chemical, for example ozone, in different phases. The chlorine dioxide bleaching is carried out with a pulp of a mean concentration, about 8 to 15%. Between the chlorine dioxide stages an alkaline bleaching step (E) is carried out, which can be combined with the addition of oxygen gas (O) and/or hydroperoxide (P), so-called (EOP)-stage, or ozone (Z(EO)).

Subsequent to the bleaching stages, the pulp is washed by dewatering, during which liquid (filtrate) is removed by means of filters or presses. The dewatering can be carried out with or without the supply of washing liquid. The pressing preferably takes place in so-called roller presses, where the pulp is pressed between two rollers so that the pulp concentration is increased to about 25 to 40%. During dewatering by means of filters, however, a pulp concentration of only about 10 to 20% is obtained. After the dewatering step, the pulp is moved to subsequent treatment stages, where the pulp concentration is adjusted by liquid addition to a level suitable for treatment in this stage.

During the method according to the present invention, filtrate is re-cycled from the dewatering step after the second chlorine dioxide stage ($D_1$) and utilized for controlling the pulp concentration of the pulp dewatered to about 25 to 40% before the first chlorine dioxide stage ($D_0$). The pulp is therefore diluted by this filtrate from about 25 to 40% to the concentration suitable in this stage ($D_0$), i.e. about 8 to 15%.

By utilizing the filtrate from $D_1$ in this manner, an unfavorable build-up of the substance content in $D_0$ can be avoided. It has, moreover, been surprisingly found that the addition of filtrate from $D_1$ results in a lowering of the kappa number and an increase in the ISO-brightness of the pulp.

BRIEF DESCRIPTION OF THE DRAWINGS

The present invention is described in greater detail in the following detailed description, with reference to the accompanying drawing in which a schematic representation of an embodiment of a flow sheet for a bleaching method according to the present invention is shown.

DETAILED DESCRIPTION

A chemical pulp, which can be oxygen gas delignified, is moved through a first roller press 1 to a first chlorine dioxide stage $D_0$. The pulp is thereafter moved through a second roller press 2 to an alkaline bleaching stage E, and further moved through a third roller press 3 to a second chlorine dioxide stage $D_1$ and from there to a fourth roller press 4, from which the pulp is moved to a subsequent treatment stage. The second, third and fourth roller press, 2,3 and 4, can possibly be replaced by filters. This, however, results in the effluent volume increasing.

Prior to the bleaching step in question, necessary chemicals are admixed thereinto in a conventional manner. To the E-stage oxygen gas and peroxide can also be added. The necessary amount of fresh water is suitably supplied to the third roller press and after the second chlorine dioxide stage $D_1$, see Figure. The filtrate, which is removed as effluent from the process, is suitably taken out from the second and third roller press, 2 and 3. The filtrate from the first roller press 1 is moved backward or recycled to previous process stages. A small portion of the filtrates from each of the roller presses, 1 through 4, is recycled in a short circulation to the pulp before the respective press, for example as shown in the Figure. From the fourth roller press 4 the main portion of the filtrate is recycled directly to the pulp in a position between the first roller press 1 and the first chlorine dioxide stage $D_0$.

In the first roller press 1 the pulp is dewatered to a concentration of about 25 to 40%, in order to reduce the content of undesired substances in the pulp before the $D_0$-stage as much as possible. Thereafter, the filtrate from the fourth roller press 4 is supplied for adjusting the pulp concentration to the level suitable for the $D_0$-stage, i.e. about 8 to 15%. After the $D_0$-stage the pulp is dewatered, and the main portion of the filtrate is removed from the process. The concentration of the pulp is again controlled with re-circulated filtrate from the subsequent roller press 3 to a concentration suitable for the E-stage, where also oxygen gas and peroxide are added (EOP). Thereafter the pulp is dewatered and, after control to the desired concentration (about 8 to 15%), moved to the $D_1$-stage. The main portion of the filtrate from this dewatering 3 is removed from the process. The $D_1$-stage can be a single chlorine dioxide stage or, alternatively, can be carried out with chlorine dioxide in two phases with an intermediate neutralization. After the $D_1$-stage the pulp is again dewatered and advanced to subsequent treatment stages, while the main portion of the filtrate is recycled to the pulp before the $D_0$-stage.

The present invention implies that the bleaching process can be made more effective since the added bleaching chemicals are utilized effectively, at the same time as the effluent volume can be kept low, which is favorable from an environmental point of view.

In the following example a comparison is made between the method according to the present invention and the known state of art, whereby the surprising technical effect of this invention becomes apparent.

EXAMPLE

An oxygen gas delignified coniferous wood pulp with a kappa number of 10.1 was pressed to a pulp concentration of 30% and bleached in a chlorine dioxide stage and subsequent alkaline stage according to the sequence D (EO). Before the addition of chlorine dioxide to the D-stage, a dilution of the pulp to 10% was made. For the dilution were used clean water, filtrate from a $D_0$-stage and, respectively, filtrate from a $D_1$-stage. The results are set forth in the Table below.

TABLE

Chlorine dioxide bleaching of oxygen gas delignified pulp with a kappa number of 10.1, an ISO-brightness of 43% and a viscosity of 915 ml/g. The kappa factor in the bleaching stage was 1.8 kg active chlorine/kappa number. The final pH 2.3–2.5.

| | After D(EO) | | |
|---|---|---|---|
| Dilution with: | Kappa number | ISO-brightness | Viscosity ml/g |
| Clean water | 2.7 | 71.6 | 887 |
| $D_0$-filtrate | 3.1 | 68.8 | 887 |
| $D_1$-filtrate | 2.5 | 72.0 | 894 |

The result shows an increase of the kappa number from 2.7 to 3.1 after D(EO) when the dilution was made with $D_0$-filtrate instead of clean water. When $D_1$-filtrate was used, there was an opposite effect. The kappa number was lowered after D(EO) from 2.7 to 2.5.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method for bleaching chemical pulp comprising dewatering said chemical pulp to a concentration of 25–40%, bleaching said dewatered chemical pulp in a first bleaching stage with chlorine dioxide to produce a partially bleached chemical pulp, bleaching said partially bleached chemical pulp in a second bleaching stage with alkaline bleaching chemicals to produce an alkaline bleached chemical pulp, bleaching said alkaline bleached chemical pulp in a third bleaching stage with chlorine dioxide to produce a bleached chemical pulp, dewatering said bleached chemical pulp to a concentration of from 10–40%, producing a filtrate thereby, and recycling the main portion of said filtrate directly to the pulp before the first chlorine dioxide stage to control said pulp concentration of said dewatered chemical pulp to from 8–15% in said first bleaching stage.

2. The method of claim 1 wherein said dewatering of said chemical pulp and said dewatering of said bleached chemical pulp are carried out by means of roller presses.

3. The method of claim 1 wherein said second bleaching stage comprises an extraction stage with the addition of oxygen gas or hydroperoxide.

4. The method of claim 1 including dewatering said partially bleached chemical pulp and dewatering said alkaline bleached chemical pulp.

5. The method of claim 4 wherein said dewatering of said partially bleached chemical pulp and said dewatering of said alkaline bleached chemical pulp are carried out by means of roller presses.

* * * * *